United States Patent [19]

Geraghty, Jr.

[11] Patent Number: 4,615,656

[45] Date of Patent: Oct. 7, 1986

[54] CYLINDER GRIPPING ATTACHMENT FOR A FORK LIFT TRUCK

[76] Inventor: Joseph T. Geraghty, Jr., c/o Geraghty Industrial Equipment, Inc., 4414 11th St., P.O. Box 3091, Rockford, Ill. 61106

[21] Appl. No.: 648,515

[22] Filed: Sep. 10, 1984

[51] Int. Cl.[4] ..... B66F 9/06

[52] U.S. Cl. ..... 414/607; 294/119.2; 414/23; 414/590; 414/745; 414/910

[58] Field of Search ..... 414/607, 608, 589, 590, 414/910, 911, 745, 23, 735, 743, 705; 294/119.2, 103.1, 74, 31.2

[56] References Cited

U.S. PATENT DOCUMENTS

| | | | |
|---|---|---|---|
| 861,342 | 7/1907 | Winter | 294/31.2 X |
| 1,102,803 | 7/1914 | Roadman et al. | 414/910 X |
| 1,331,938 | 2/1920 | McConnell et al. | 414/910 X |
| 1,540,204 | 6/1925 | Cannon et al. | 414/910 X |
| 2,290,565 | 7/1942 | Lagana | 294/103.1 X |
| 2,410,378 | 10/1946 | Gallamore | 294/74 |
| 2,827,184 | 3/1958 | Mueller | 414/607 X |
| 3,112,830 | 12/1963 | Podlesak | 414/23 |
| 3,272,529 | 9/1966 | Rachman | 294/31.2 X |
| 3,384,247 | 5/1968 | Teagle | 414/743 |
| 3,512,670 | 5/1970 | Howard | 414/607 |
| 3,893,579 | 7/1975 | Glewwe | 414/607 X |
| 4,212,577 | 7/1980 | Swanson | 414/23 |
| 4,280,785 | 7/1981 | Albrecht | 414/743 X |
| 4,318,661 | 3/1982 | Helm | 414/607 |
| 4,340,333 | 7/1982 | Cashio | 414/607 |
| 4,385,860 | 5/1983 | Corbin | 414/607 X |

*Primary Examiner*—Joseph E. Valenza
*Assistant Examiner*—David A. Bucci
*Attorney, Agent, or Firm*—Leydig, Voit & Mayer, Ltd.

[57] ABSTRACT

A gripping mechanism for clamping a hydraulic cylinder is adapted to be releasably mounted on the fork of a fork lift truck and is adapted to be rotated to different angular positions about an axis extending longitudinally of the truck. The gripping mechanism also may be used to enable a chain fall to lift either a horizontally disposed cylinder or a vertically disposed cylinder.

9 Claims, 8 Drawing Figures

CYLINDER GRIPPING ATTACHMENT FOR A FORK LIFT TRUCK

BACKGROUND OF THE INVENTION

This invention relates to an attachment for a fork lift truck and particularly adapted to enable the fork of the truck to grip and lift a generally cylindrical member such as a large hydraulic cylinder.

Various attachments have been proposed to enable fork lift trucks to handle various types of cylindrical members. Such attachments are disclosed, for example, in Mueller U.S. Pat. No. 2,827,184; Howard U.S. Pat. No. 3,512,670; Glewwe U.S. Pat. No. 3,893,579 and Cashio U.S. Pat. No. 4,340,333.

SUMMARY OF THE INVENTION

The general aim of the present invention is to provide a new and improved fork lift attachment which is capable of securely gripping a cylindrical member located in any of several different angular positions and which is capable of turning the cylindrical member to a different angular position about an axis extending parallel to the longitudinal axis of the fork lift truck. As a result, the attachment may be used to help install or remove an object such as a hydraulic cylinder regardless of the mounted orientation of the cylinder.

A further object of the invention is to provide an attachment which not only may be used with a fork lift truck but which may be used with a chain fall to enable the latter to lift either vertically or horizontally oriented cylindrical members.

The invention also resides in the unique construction of the mechanism for gripping the cylindrical member and in the novel mounting of such mechanism for turning to different angular positions.

These and other objects and advantages of the invention will become more apparent from the following detailed description when taken in conjunction with the accompanying drawings

DETAILED DESCRIPTION OF THE PREFERRED EMBODIMENT

Figure 1:
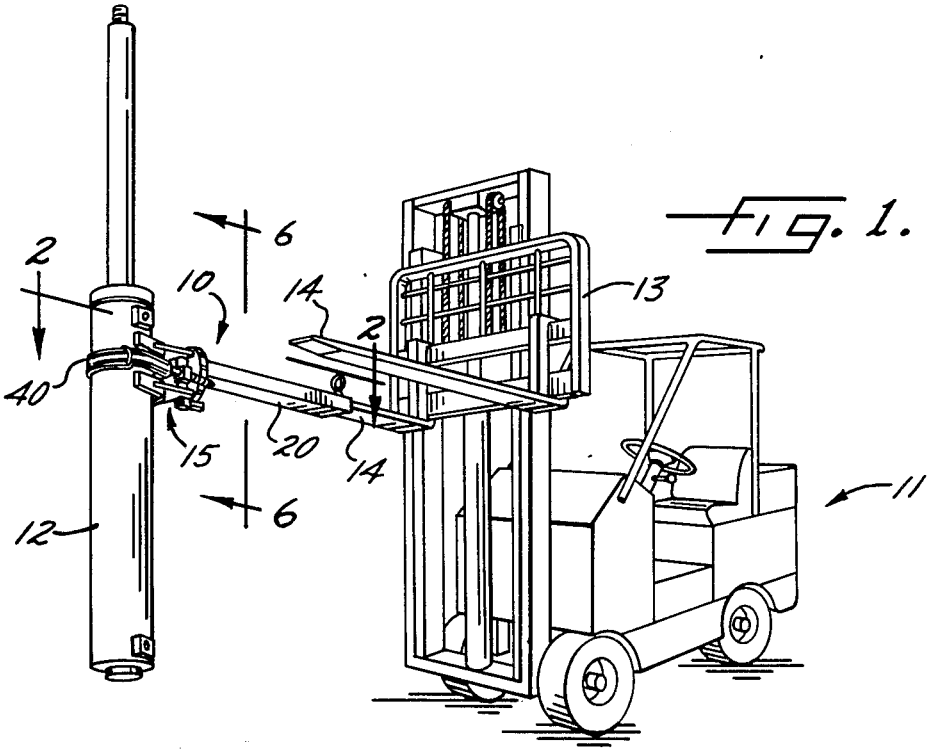
FIG. 1 is a perspective view of a typical fork lift truck equipped with a gripping and lifting attachment incorporating the unique features of the present invention.

As shown in the drawings for purposes of illustration, the invention is embodied in an attachment 10 for a fork lift truck 11 and adapted to enable a generally cylindrical member 12 to be gripped, lifted and transported by the truck. Herein, the member 12 has been shown as being a large hydraulic cylinder of the type commonly used with large farm equipment, heavy construction machinery or machine tools.

The fork lift truck 11 is of conventional construction and includes the usual vertically movable fork mechanism 13. The fork includes two laterally spaced and forwardly projecting prongs 14.

The attachment 10 of the present invention is characterized in that it includes a gripping mechanism 15 adapted to be rotated to different angular positions about a horizontal axis extending parallel to the longitudinal axis of the fork lift truck 11. In this way, the gripping mechanism may be positioned to hold a hydraulic cylinder 12, for example, in any angular position that might be necessary to enable the cylinder to be installed on or removed from a piece of equipment. The rotatable gripping mechanism also facilitates the general handling of other substantially cylindrical members.

Figure 3:
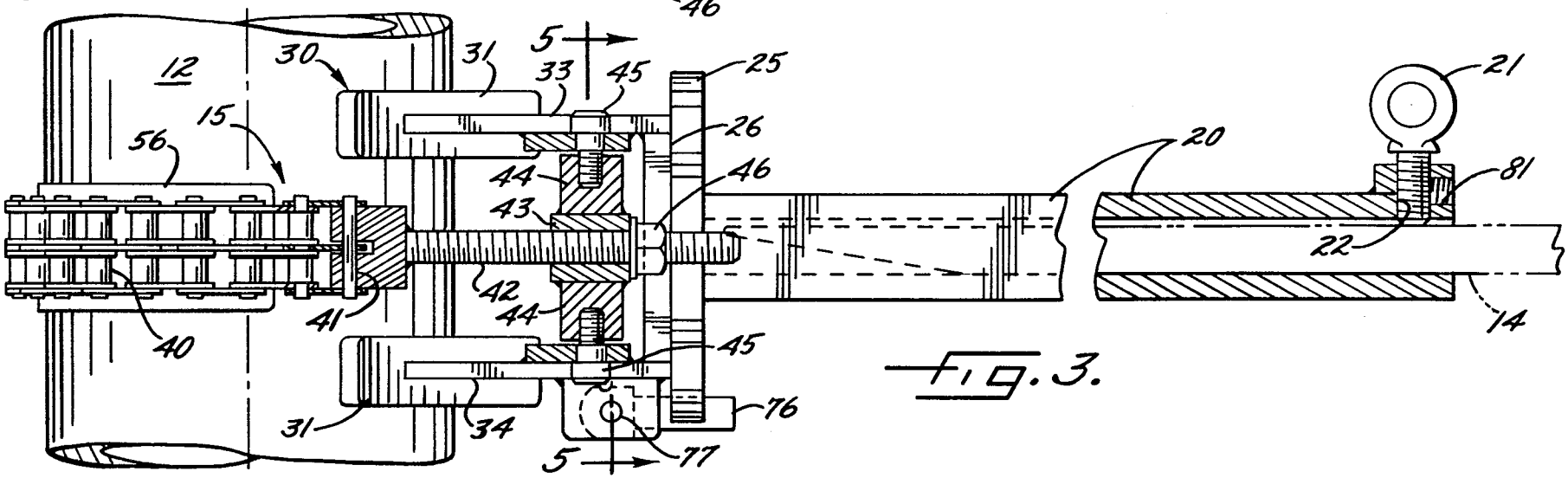

More specifically, the attachment 10 comprises an elongated mounting bracket 20 which herein is in the form of a tube of rectangular cross-section. The tube 20 is sized to telescope over one of the prongs 14 and is adapted to be anchored securely to the prong by a bolt 21 (FIG. 3). In this instance, the bolt 21 is in the form of an eye bolt which is screwed into a threaded hole 22 formed through one wall of the tube 20 and opening into the inner side thereof. When the bolt is tightened, it acts in the manner of a set screw to clamp the tube releasably to the prong.

A generally circular plate 25 is welded to the outer end of the mounting tube 20 and serves as a fixed mounting plate for the gripping mechanism 15. Herein, the gripping mechanism comprises a rotatable plate 26 disposed in face-to-face relation with the fixed plate 25 and further includes a cradle 30 (FIGS. 2 and 3) for receiving the cylinder 12 with the axis of the cylinder extending transversely of the longitudinal axis of the truck 11. The cradle 30 is defined by upper and lower vertically spaced pairs of wings 31, the wings of each pair being arranged to form a forwardly opening V (see FIG. 2). Upper and lower forwardly projecting plates 33 and 34 are welded to the rotatable plate 26 and support the upper and lower pairs of wings, respectively.

Figure 2:
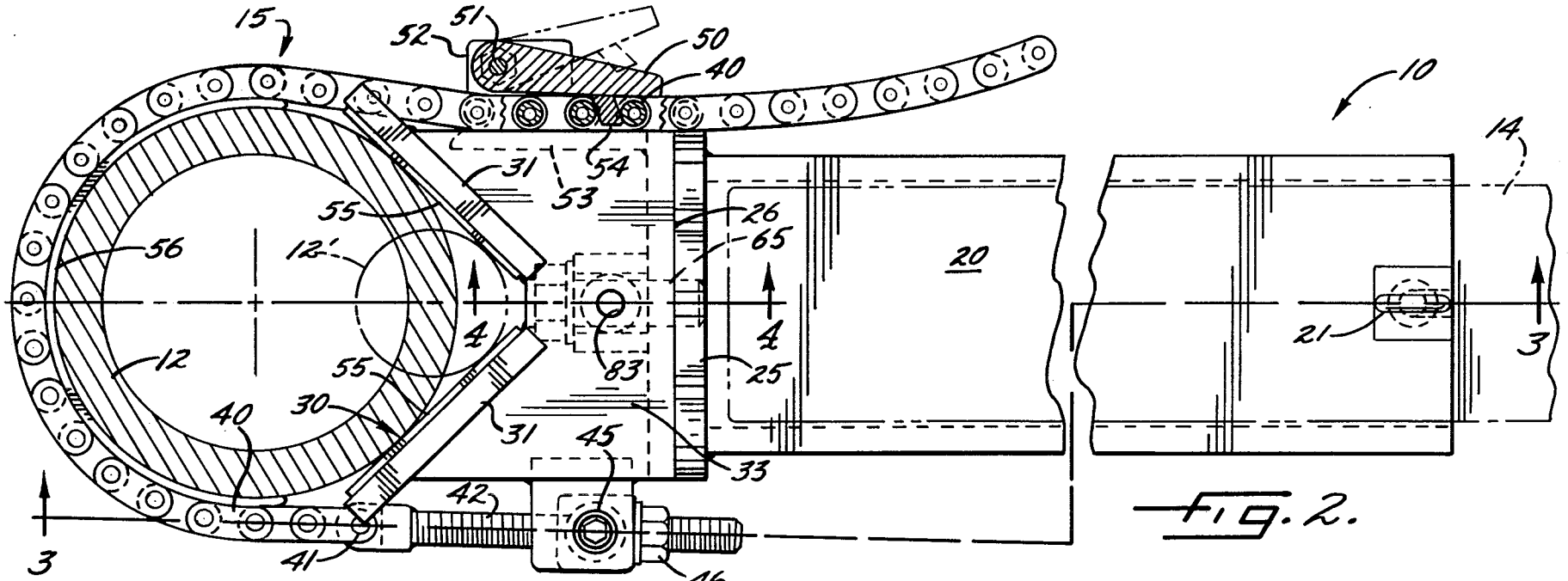
FIG. 2 is an enlarged fragmentary cross-section taken substantially along the line 2—2 of FIG. 1.

Cylindrical members of various diameters may be received in the cradle 30 as indicated by the large-diameter hydraulic cylinder 12 shown in solid lines in FIG. 2 and the smaller-diameter cylindrical member 12' shown in phantom lines. In order to clamp the cylinder in the cradle, provision is made of strap means in the form of a double row roller chain 40 adapted to be cinched around the cylinder. As shown most clearly in FIGS. 2 and 3, one end of the chain is connected pivotally at 41 to the forward end portion of elongated threaded rod 42. The rear end portion of the rod extends slidably through a collar 43 located between the plates 33 and 34 and is pivotally connected thereto by a pair of trunnions 44 and a pair of pivot pins 45. A nut 46 is threaded onto the rear end portion of the rod 42 and engages the rear end of the collar 43.

Figure 5:
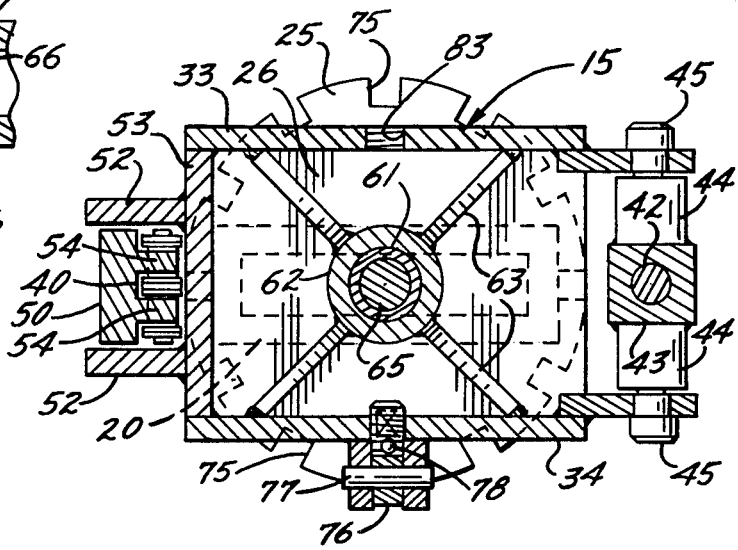
FIG. 5 is a cross-section taken substantially along the line 5—5 of FIG. 3.

After the chain 40 has been wrapped around the cylinder 12, its free end portion is adapted to be fastened quickly in place preparatory to final tightening of the chain. For this purpose, a lever 50 (FIGS. 2 and 5) is pivotally mounted at 51 between a pair of ears 52 extending outwardly from a side plate 53 located between and fastened to the plates 33 and 34. When the lever is pivoted from the position shown in phantom lines in FIG. 2 to the position shown in full lines, two dogs 54 on the lever enter between the links of the chain 40 to hold the free end portion of the chain. Thereafter, the nut 46 may be tightened to cinch the chain tightly around the cylinder 12. As the chain tightens, its links cam against the dogs 54 and force the lever 50 to remain in its locked position.

Fabric pads 55 (FIG. 2) are cemented to the forward faces of the wings 31 of the cradle 30 to facilitate gripping of the cylinder 12 and to avoid marring of polished chrome cylinders. In addition, a pad 56 is secured to the rear face of the chain 40.

Figure 4:
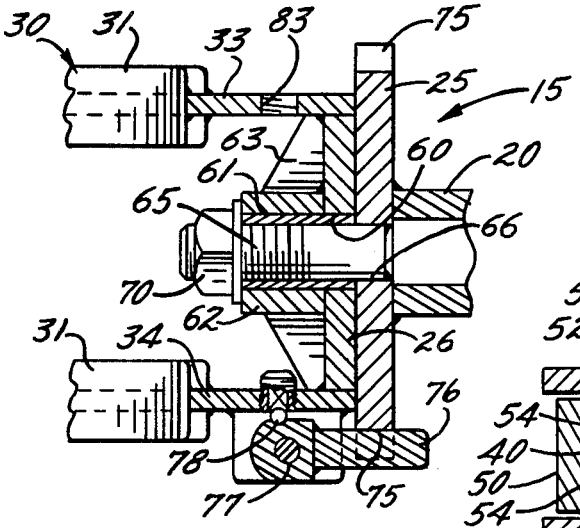
FIGS. 3 and 4 are fragmentary cross-sections taken substantially along the lines 3—3 and 4—4, respectively, of FIG. 2.

In order to mount the gripping mechanism 15 for rotation on the mounting bracket 20 in accordance with the invention, the rotatable plate 26 is formed with a central hole 60 (FIG. 4) which receives a bushing 61. The bushing also extends into a tubular hub 62 fixed to the forward side of the plate 26, there being gussets 63 extending between the hub and the plates 33 and 34. A bolt 65 is welded rigidly within a hole 66 in the fixed plate 25 and extends through the bushing to support the entire gripping mechanism 15 for rotation relative to the fixed plate 25 about a horizontal axis extending parallel to the longitudinal axis of the fork lift truck 11. A nut 70 on the forward end of the bolt engages the hub to captivate the plate 26 axially with respect to the plate 25 while allowing the plate 26 to rotate.

Figure 6:
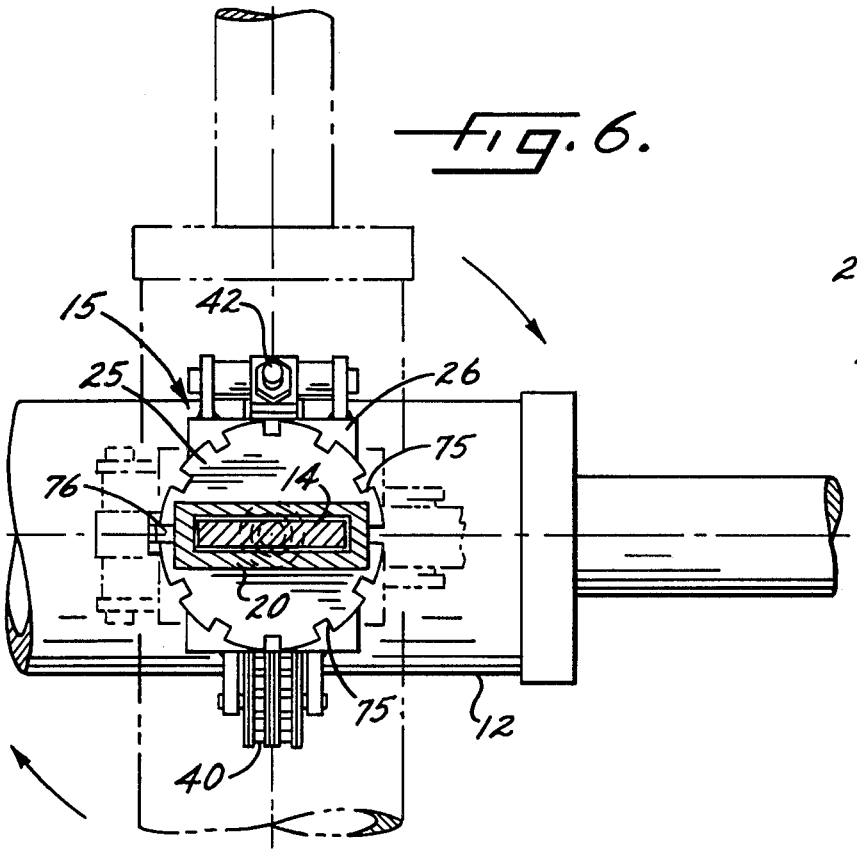
FIG. 6 is an enlarged fragmentary cross-section taken substantially along the line 6—6 of FIG. 1.

By rotating the gripping mechanism 15 about the axis of the bolt 65, the cylinder 12 may be turned through a full 360 degrees or may be turned to and held in selected angular positions. For example, FIG. 6 shows the cylinder after having been rotated through 90 degrees from a vertical position to a horizontal position. To hold the gripping mechanism 15 in selected angular positions, twelve angularly spaced detent openings or notches 75 (FIG. 5) are formed in the periphery of the fixed plate 25. A manually releasable detent in the form of a pawl 76 (FIG. 4) is adapted to be located in any selected one of the notches to hold the gripping mechanism 15 against rotation relative to the plate 25. The pawl is pivotally mounted on a pin 77 secured to the plate 34 and is automatically urged to a latched position by a spring-loaded ball 78 which also is supported by the plate 34.

From the foregoing, it will be apparent that the fork lift attachment 10 of the present invention enables the gripping mechanism 15 to be turned angularly to any position which might be necessary to permit the gripping mechanism to clamp the cylinder 12. Moreover, the gripping mechanism may be releasably held at 30 degree increments. Thus, the attachment is particularly useful as an aid in installing or removing heavy equipment cylinders since the gripping mechanism can be oriented to match the orientation of the cylinder on the equipment.

Figure 7:
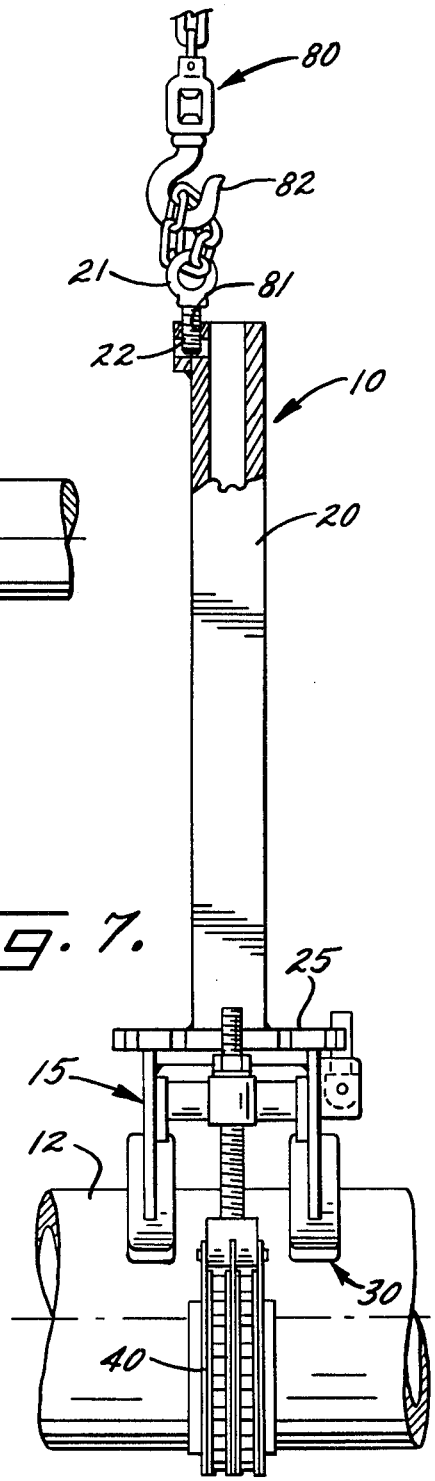
FIG. 7 is a side elevational view showing the attachment used with a chain fall and gripping a horizontally disposed hydraulic cylinder.
Figure 8:
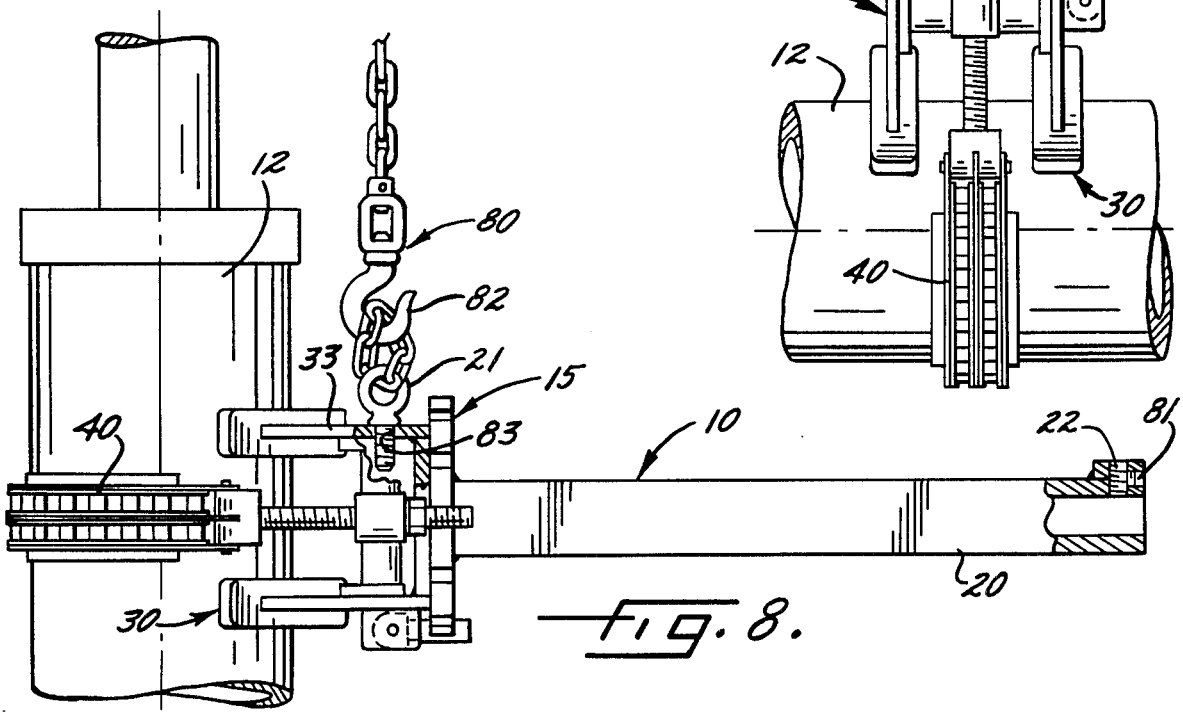
FIG. 8 is a side elevational view showing the attachment used with a chain fall and gripping a vertically disposed hydraulic cylinder.

The attachment 10 not only is usable with the fork lift truck 11 but also can enable a cylinder 12 to be lifted by a chain fall 80 (FIGS. 7 and 8). As shown in FIG. 7, the eye bolt 21 for clamping the mounting tube 20 to the prong 14 can be removed from the hole 22 and can be screwed into a second threaded hole 81 formed in the rear end of the tube. The eye bolt then can be used as a means for coupling the attachment 10 with the hook 82 of the chain fall to enable the chain fall to lift a horizontally disposed cylinder 12. Alternatively, the eye bolt 21 may be placed in an upwardly opening threaded hole 83 (FIG. 8) in the plate 33 and may be coupled with the hook 82 to enable the chain fall to lift a vertically disposed cylinder 12.

I claim:

1. An attachment for a fork of a fork lift truck having a longitudinal axis extending along a direction of travel of the truck, said attachment being adapted to enable a generally cylindrical member having a longitudinal axis to be gripped and transported by the truck, said attachment comprising a mounting bracket, means for securing said mounting bracket releasably to a prong of the fork, a gripping mechanism for holding a generally cylindrical member with the axis of the member extending transversely of the longitudinal axis of the truck, said gripping mechanism comprising a cradle for receiving said cylindrical member and further comprising selectively operable means for releasably strapping said cylindrical member in said cradle, means mounting said gripping mechanism on the forward end portion of said mounting bracket for rotation through 360 degress in either direction about a generally horizontal axis extending substantially parallel to the longitudinal axis of the truck, and selectively operable means for releasably holding said gripping mechanism in selected angular positions relative to said mounting bracket whereby a generally cylindrical member placed in the gripping mechanism while in one angular position may be turned about said generally horizontal axis to a different angular position prior to or after being transported by the truck, said holding means being operable when released to enable said gripping mechanism and said cylindrical member to be turned through 360 degrees in either direction relative to said mounting bracket, said mounting bracket and said gripping mechanism comprising generally vertical plates disposed in face-to-face relation, a series of angularly spaced detent openings formed around one of said plates, said holding means comprising a detent connected with the other of said plates and selectively movable into and out of said detent openings.

2. An attachment as defined in claim 1 in which said one plate is connected rigidly to the forward end portion of said mounting bracket, said other plate being connected to and being rotatable with said gripping mechanism, said detent comprising a pawl rotatable with said gripping mechanism and supported thereon to pivot into and out of said detent openings.

3. An attachment as defined in claim 1 in which said cradle comprises a pair of wings disposed at an angle relative to one another and defining a forwardly opening V, said strapping means comprising a flexible chain adapted to be cinched around said cylindrical member, said chain having one end portion anchored adjacent one of said wings, and means for releasably holding the other end portion of said chain adjacent the other of said wings.

4. An attachment as defined in claim 3 in which said means for releasably holding said chain comprises a pivoted lever having a dog sized to fit between the links of said chain.

5. An attachment as defined in claim 1 in which said mounting bracket comprises an elongated tubular member sized to telescope over said prong.

6. An attachment as defined in claim 5 in which a threaded hole is formed through the wall of said tubular member and opens into the inside thereof, said securing means comprising a bolt threaded into said hole and operable to clamp said prong within said tubular member.

7. An attachment as defined in claim 6 and having a second threaded hole which opens upwardly when said gripping mechanism is oriented to hold said cylindrical member in a generally vertical position, said bolt being in the form of an eye bolt sized to thread into said second hold and adapted to coact with a hook of a chain fall for lifting said attachment with said cylindrical member disposed in a generally vertical position.

8. An attachment as defined in claim 7 in which an additional threaded hole is formed in said mounting bracket and opens out of one end thereof, said eye bolt being sized to thread into said additional hole and to coact with the hook of the chain fall to enable the chain fall to lift said attachment with said cylindrical member disposed in a generally horizontal position.

9. The combination of a fork lift truck having a longitudinal axis extending along a direction of travel of the truck and having a vertically movable fork with transversely spaced prongs, and an attachment for enabling the truck to lift and transport a generally cylindrical member having a longitudinal axis, said combination being characterized in that said attachment comprises a mounting bracket secured releasably to one of said prongs, a gripping mechanism for holding a generally cylindrical member with the axis of the member extending transversely of the longitudinal axis of the truck, said gripping mechanism comprising a cradle for receiving said cylindrical member and further comprising selectively operable means for releasably holding said cylindrical member in said cradle, means mounting said gripping mechanism on the forward end portion of said mounting bracket for rotation through 360 degrees in either direction about a generally horizontal axis extending substantially parallel to the longitudinal axis of thr truck, and selectively operable means for releasably holding said gripping mechanism in selected angular positions relative to said mounting bracket whereby a generally cylindrical member placed in the gripping mechanism while in one angular position may be turned about said generally horizontal axis to a different angular position prior to or after being transported by the truck, said holding means being operable when released to enable said gripping mechanism and said cylindrical member to be turned through 360 degrees in either direction relative to said mounting bracket, said mounting bracket and said gripping mechanism comprising generally vertical plates disposed in face-to-face relation, a series of angularly spaced detent openings formed around one of said plates, said holding means comprising a detent connected with the other of said plates and selectively movable into and out of said detent openings.

* * * * *